US007718875B2

(12) United States Patent
Shereda

(10) Patent No.: US 7,718,875 B2
(45) Date of Patent: May 18, 2010

(54) GUITAR CORD SECURING APPARATUS

(76) Inventor: Daniel Shereda, 655 Wheelock Ave., Medford, WI (US) 54451

( * ) Notice: Subject to any disclaimer, the term of this patent is extended or adjusted under 35 U.S.C. 154(b) by 0 days.

(21) Appl. No.: 12/250,655

(22) Filed: Oct. 14, 2008

(65) Prior Publication Data

US 2009/0100982 A1 Apr. 23, 2009

Related U.S. Application Data

(60) Provisional application No. 60/999,464, filed on Oct. 18, 2007.

(51) Int. Cl.
*G10D 3/00* (2006.01)

(52) U.S. Cl. ..... 84/327

(58) Field of Classification Search ..... 84/421, 84/327, 329

See application file for complete search history.

(56) References Cited

U.S. PATENT DOCUMENTS 6,198,031 B1 3/2001 Jones
2004/0020344 A1* 2/2004 Bazata ..... 84/327

OTHER PUBLICATIONS

Musician's Friend—Product Images—Dunlop Dual-Design Straplock System, http://accessories.musiciansfriend.com/product/images?base_pid=364008&page=1.
Buy Dunlop Dual-Design Straplock System online at Musician's Friend, http://accessories.musiciansfriend.com/product/Dunlop-DualDesign-Straplok-System?sku=364008.

* cited by examiner

*Primary Examiner*—Kimberly R Lockett
(74) *Attorney, Agent, or Firm*—Ryan, Mason & Lewis, LLP

(57) ABSTRACT

In an embodiment, an apparatus includes a first section including a protrusion-engaging portion and a second section including a first coupling member adapted to mate to a second coupling member attachable to a guitar cord.

14 Claims, 12 Drawing Sheets

GUITAR CORD SECURING APPARATUS

CROSS-REFERENCE TO RELATED APPLICATIONS

This patent application claims the benefit of U.S. Provisional Patent Application Ser. No. 60/999,464 filed on Oct. 18, 2007, and entitled "Guitar Cord Securing Apparatus." The complete disclosure of the aforementioned Provisional Patent Application Ser. No. 60/999,464 is expressly incorporated herein by reference in its entirety for all purposes.

TECHNICAL FIELD

This invention generally relates to musical instruments, and more particularly to a new and improved apparatus for securing and protecting electric guitar cords.

BACKGROUND

Electric guitars are supported by the player during use with guitar straps. These guitars traditionally make use of electrical cords or coaxial-type cables that are attached, on one end, to sockets on the guitar face or side. During use, the cord is subject to inadvertent removal relative to the socket on the instrument when, for instance, the player (or another person) steps on the cord as the player is moving. This risk has led some players to feed the cord between the guitar strap and the player's body before attaching it to the cord socket. While this provides some protection, it is not always effective, particularly during substantial movement.

Therefore, there is a need for an apparatus that is easy to use and effective in securing a cord to the electric guitar so as to prevent inadvertent removal.

SUMMARY OF THE INVENTION

The present invention relates to a cord securing apparatus that functions to keep guitar players from stepping on or tripping over their guitar cords and to protect the cord and guitar from damage due to inadvertent stepping onto the cord as it lies on the ground.

The cord securing apparatus of this invention advantageously allows the player to easily secure the cord to the guitar strap/button or locking system and to easily unsecure it after use.

The cord securing apparatus includes a first section including a protrusion-engaging portion and a second section including a first coupling member adapted to engage to a second coupling member attachable to a guitar cord. Preferably, the apparatus includes the second coupling member. A cord connector is preferably included to be engageable with the cord and the second coupling member.

The cord securing apparatus further includes a floating button member adapted to engage the protrusion-receiving hole of the apparatus. The floating button member preferably includes a base and a protrusion adapted to pass through a strap hole and securably engage with the protrusion-receiving portion.

The protrusion-receiving portion of the cord securing apparatus preferably includes a hole formed in a surface proximate thereto and alternatively can include a removeable tie strap adapted for integration with the first section.

The cord connector of the cord securing apparatus preferably permits the second coupling member to move along the guitar cord when it is engaged thereto.

Another aspect of the present invention is the floating strap button member that includes a base and protrusion adapted to engage through a strap hole. It is preferable that the floating strap button member further includes a functional member adapted to engage with the protrusion. The functional member could include a cord securing apparatus.

Other aspects, features and embodiments of the invention will be more fully apparent from the ensuing disclosure and appended claims.

BRIEF DESCRIPTION OF THE DRAWINGS

Embodiments of the invention may be best understood by referring to the following description and accompanying drawings, which illustrate such embodiments. Reference numbers are the same for those elements that are the same across different Figures. In the drawings.

DETAILED DESCRIPTION OF THE PREFERRED EMBODIMENT

Figure 1:
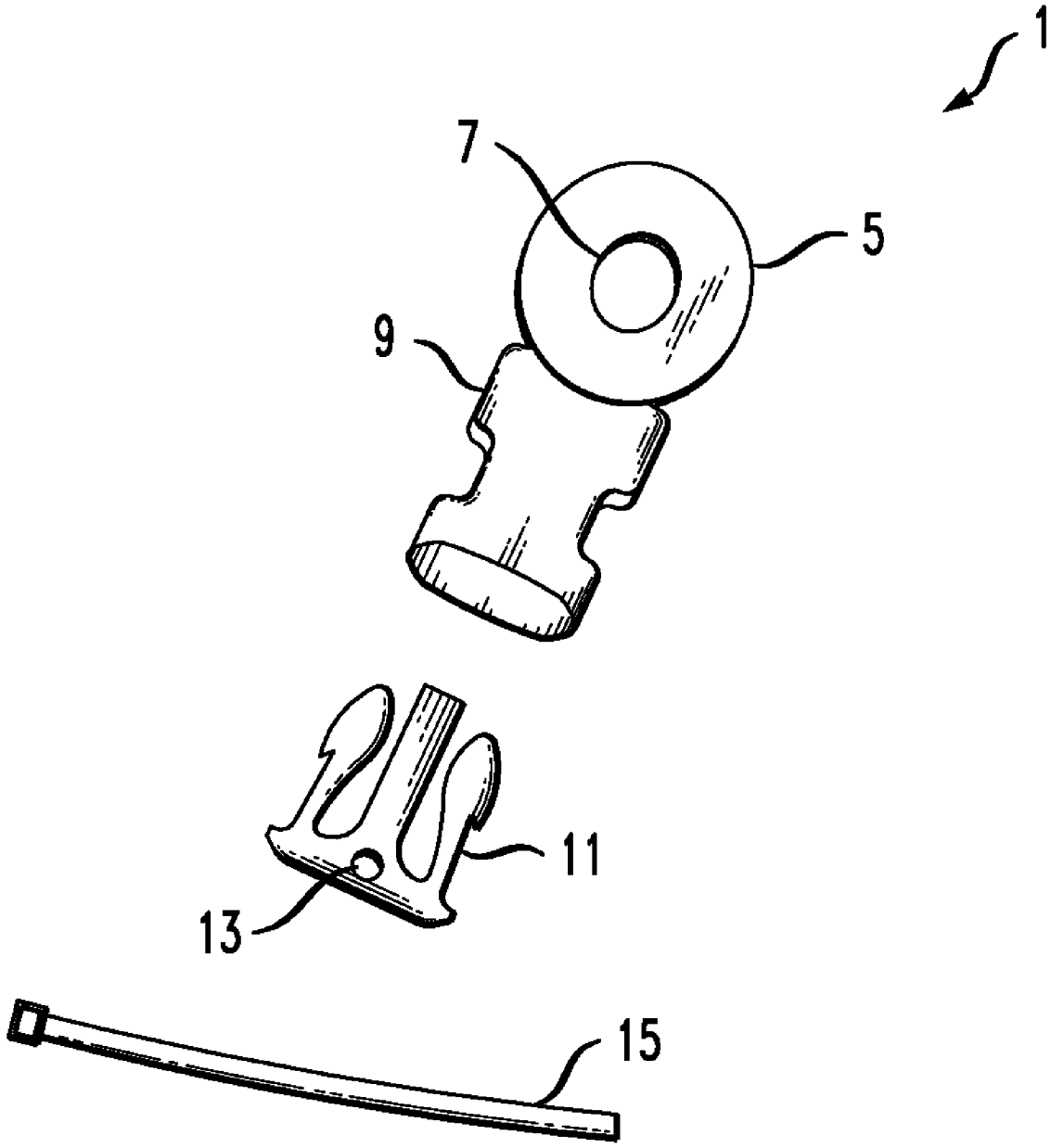
FIG. 1 illustrates an exemplary cord securing apparatus, according to one embodiment of the present invention.
Figure 2:
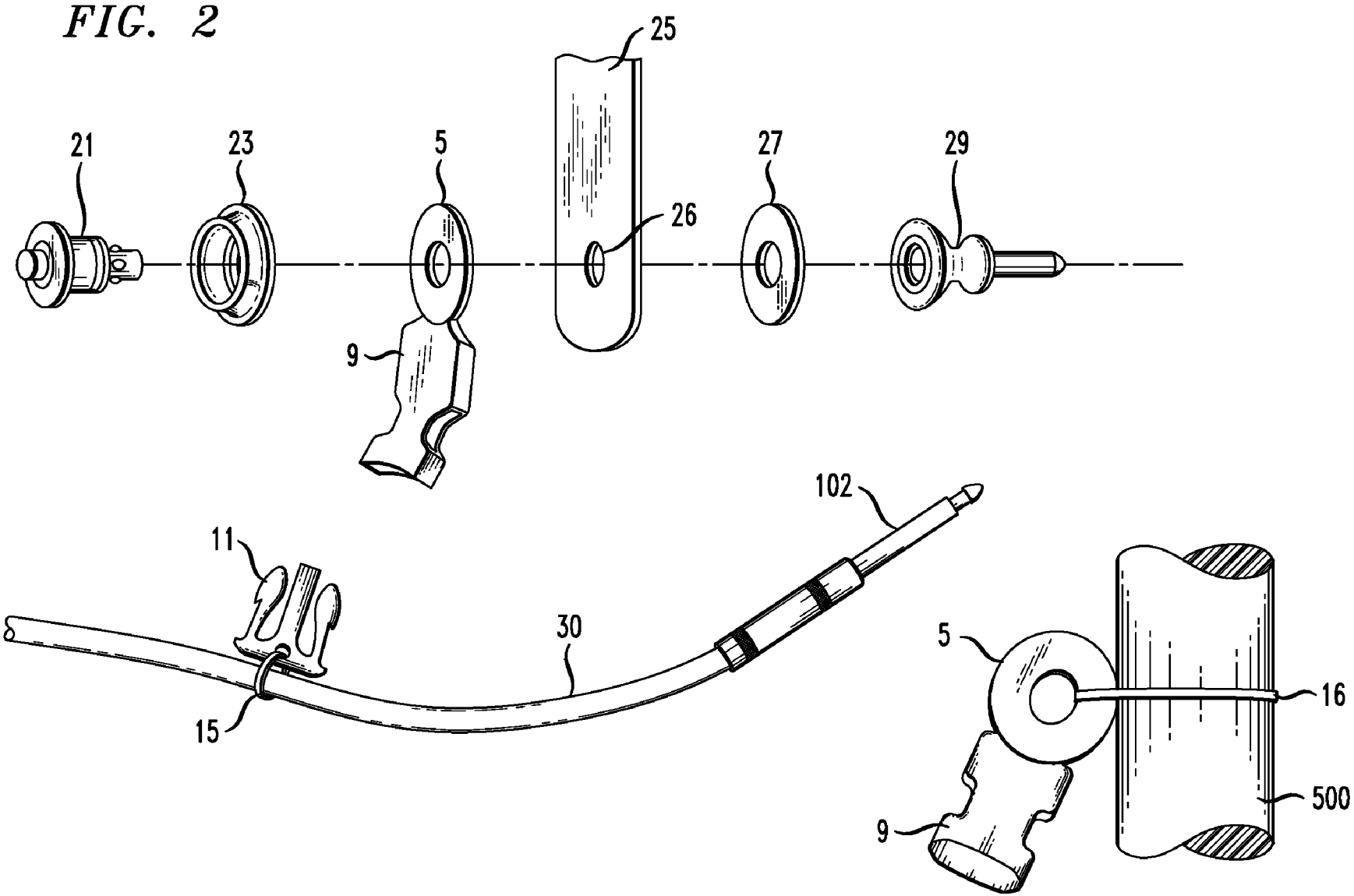
FIG. 2 illustrates the exemplary cord securing apparatus of FIG. 1, one end as attached to the cord and showing an exploded view of the other end in relation to a guitar button apparatus.

FIG. 1 illustrates an embodiment of the cord securing apparatus 1. The apparatus includes two portions, a first attachment portion 9 and a protrusion-receiving portion 5. Preferably, the protrusion-receiving portion includes a hole 7 that is adapted to securely engage with a guitar button or post. It is preferable that the cord securing apparatus 1 also include a second attachment portion 11 adapted to engage with the first attachment portion when in use. These attachment portions can be male and female mating structures or other engageable physical structures as are known to those skilled in the art. In one or more embodiments, the attachment portions can be mating halves of a plastic side-release buckle of the kind used for belts, backpacks, and the like. Of course, other structures could be used, for example, center-release plastic buckles. Preferably, the second attachment portion 11 is formed with a recess or similar configuration 13 for engaging with a cord binding member 15. The cord binding member 15 serves to secure the apparatus to a guitar cord 30, as shown in FIG. 2. While the cord binding member is shown to be a plastic cable tie, one skilled in the art would appreciate that alternative binding devices could be used, such as clips or closures, lengths of string or cord, and the like.

FIG. 2 illustrates the cord securing apparatus of FIG. 1 in relation to a strap locking system such as the Dunlop STRAPLOK SYSTEM® brand of quick release fastener for musical instrument harness (registered mark of Dunlop Manufacturing, Inc. Corporation Assignee Of California 150 Industrial Way Benicia Calif. 94510) (hereinafter referred to as a strap locking system). The cord securing apparatus of FIG. 2 includes the separate second attachment portion 11. As shown, the associated cord binding member 15 has been secured to the guitar cord 30. It will be appreciated that when it is desired to have element 11 slide along cord 30, member 15 may be loosely fastened, while if it is desired to fix element 11 to cord 30, member 15 may be tightly fastened. The first attachment portion 9 and the protrusion-receiving portion 5 are aligned with an exploded view of the portions of the strap locking system including the lock 21, recessed washer 23, guitar strap 25 with hole 26, washer 27 and strap button 29 (additional components of locking system shown in FIG. 5). It is preferable that the protrusion-receiving portion 5 have a substantially flat face so as to easily fit within this standard strap locking system. While, in this embodiment, the protrusion-receiving portion 5 engages with the lock 21 of the strap lock system (and under washer 23), the cord securing apparatus of the present invention can be used simply with a standard guitar button or post, such as item 29 in FIG. 2. Once secured to the locking system (or guitar button/post), the guitar player can simply engage one attachment portion to the other so that the guitar strap is secured to the system as well. As a result, any pulling of the cord will result in strain on the cord 30 and strap 25 by the cord securing apparatus 1, as opposed to putting strain on the cord plug 102.

Figure 3:
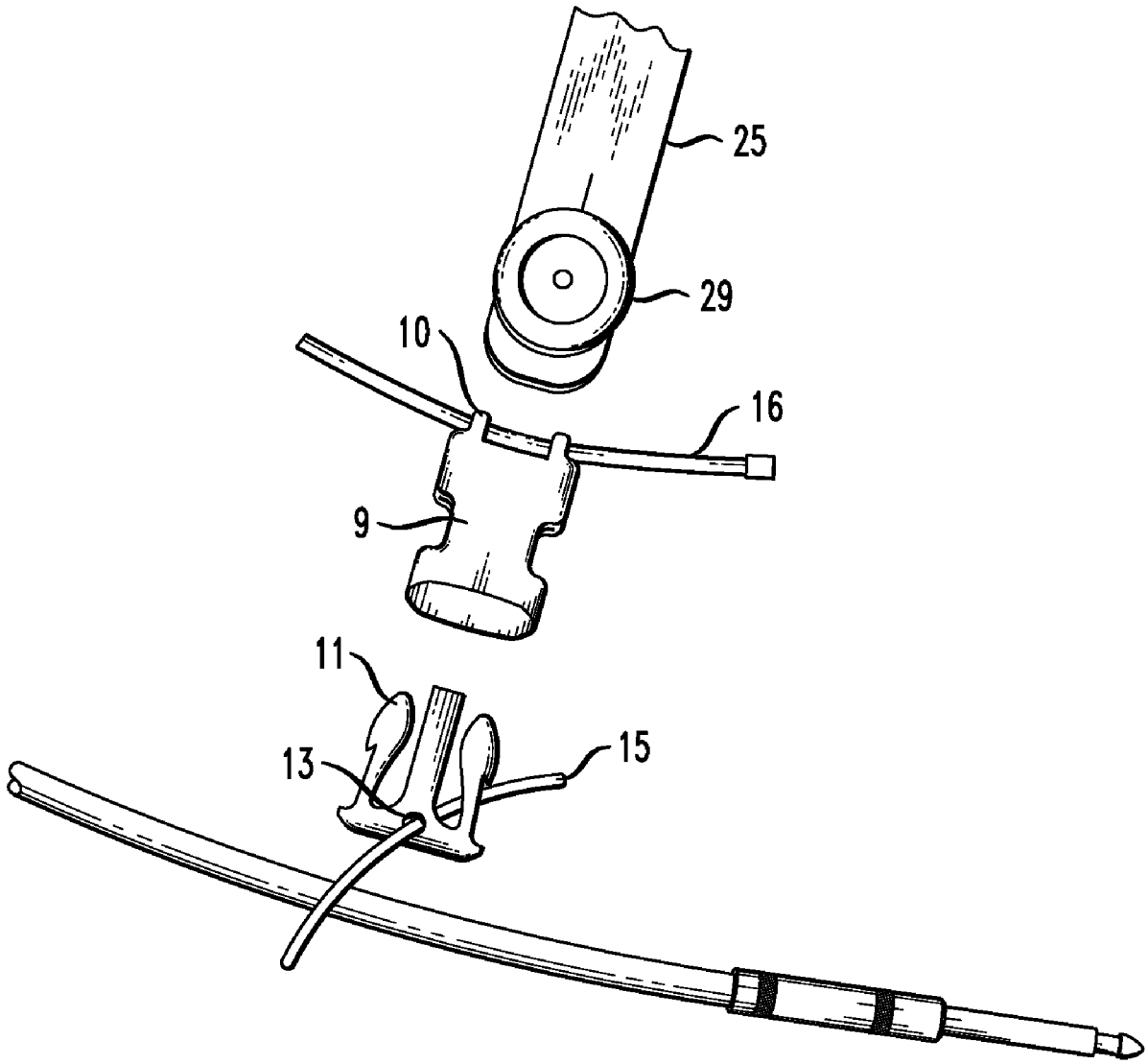
FIG. 3 illustrates an exemplary cord securing apparatus, according to another embodiment of the present invention.

FIG. 3 illustrates an alternative embodiment of the cord securing apparatus 1 where the first attachment portion 9 includes a receptacle 10 adapted to receive a binding member 16 that functions to bind the first attachment portion 9 to the guitar button or locking system lock 29 and, ultimately, the strap 25. One skilled in the art can appreciate that the receptacle can be formed in many different manners such as a recess, hole, a channel, two protruding ears with holes, and so on, and that the binding member 16 can be formed of a plastic cable tie (as shown) or some other clip or closure member, for example, as discussed above with regard to member 15.

Figure 4:
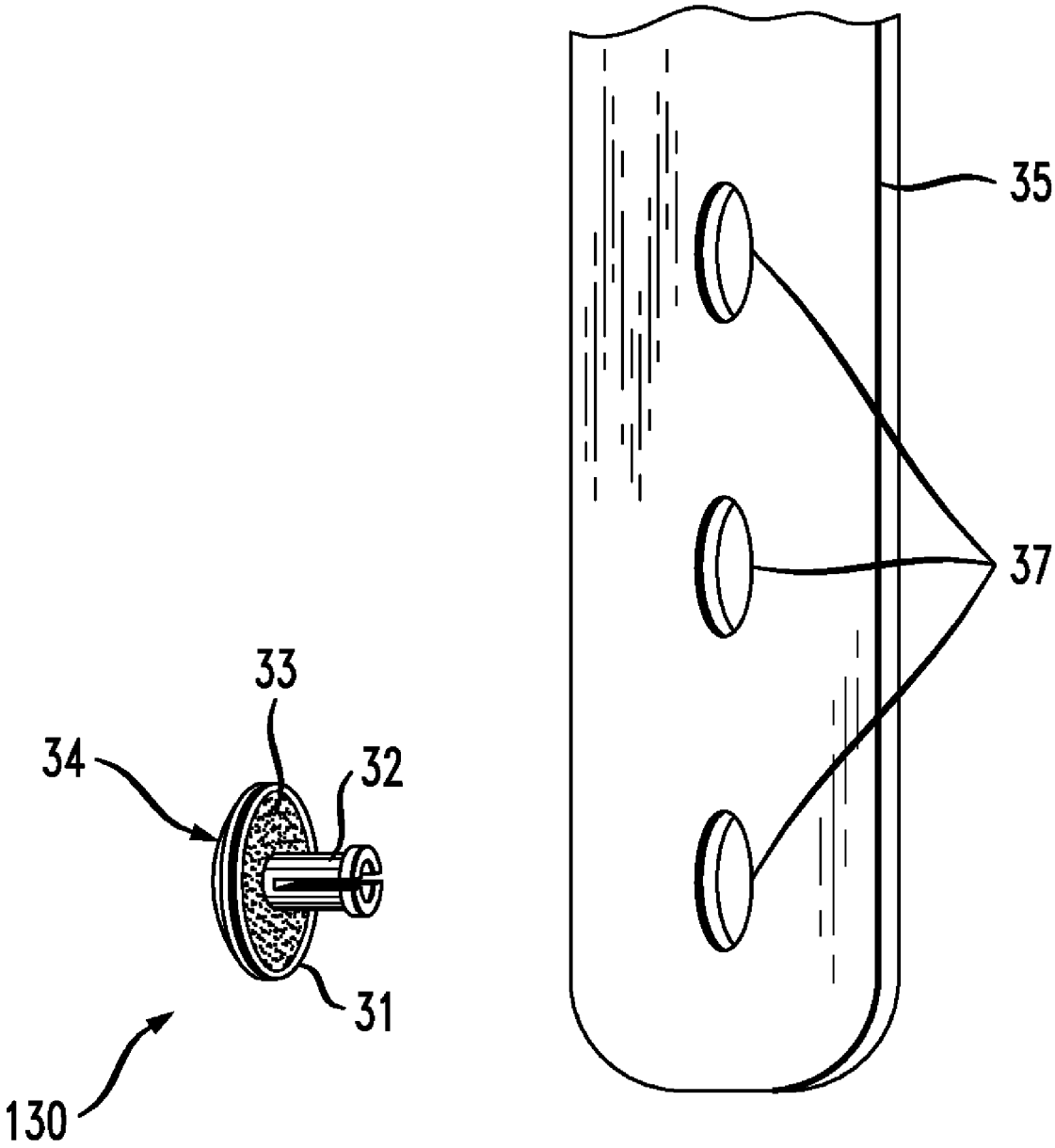
FIG. 4 illustrates an additional aspect of the present invention for use in conjunction with the apparatus.

FIG. 4 shows a multi-hole guitar strap 35 with holes 37 (strap 25 was depicted with a single hole 26). An aspect of the present invention is to enable use of the cord securing apparatus with an open (unused) hole of the strap 35. To facilitate this engagement, a floating button 130 is provided. The floating button 130 includes a base 31 and a protrusion 32 for protruding through a strap hole 37 for engagement with the cord securing apparatus of the present invention. Preferably, the base 31 is substantially flat or completely flat. It can be shaped in a circle or oval for ease of use. The front surface 33 generally abuts the back face of strap 35 with protrusion 32 extending outwardly through hole 37 to engage hole 7 of protrusion-receiving portion 5. It is also preferable for the back surface 34 of the base 31 to include a soft surface material such as felt (for example, in the form of a felt punching 134, shown in FIG. 5) to protect the guitar face from scratching.

Figure 5:
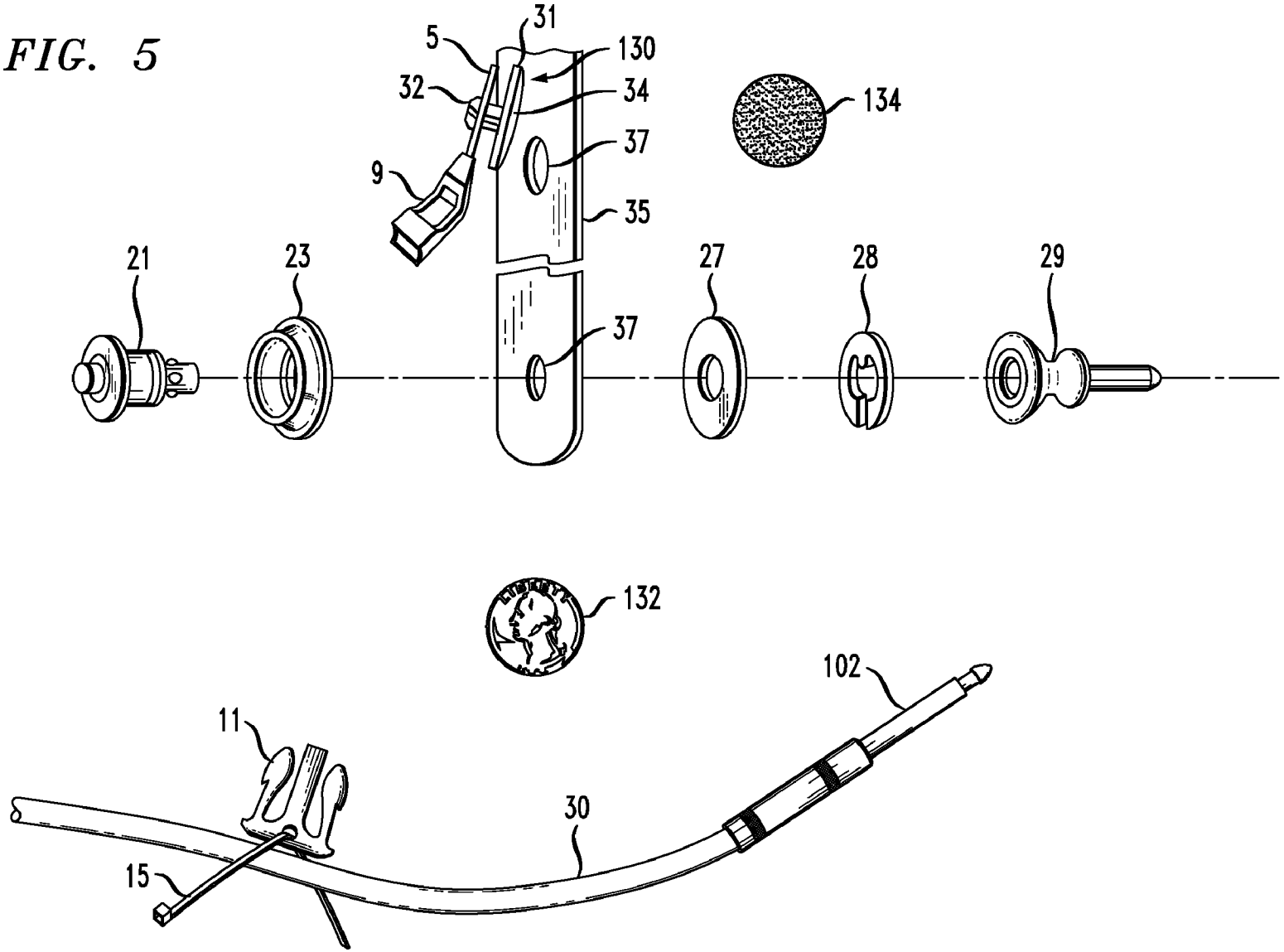
FIG. 5 illustrates the aspect of FIG. 4 in conjunction with the cord securing apparatus of FIG. 1.
Figure 6:
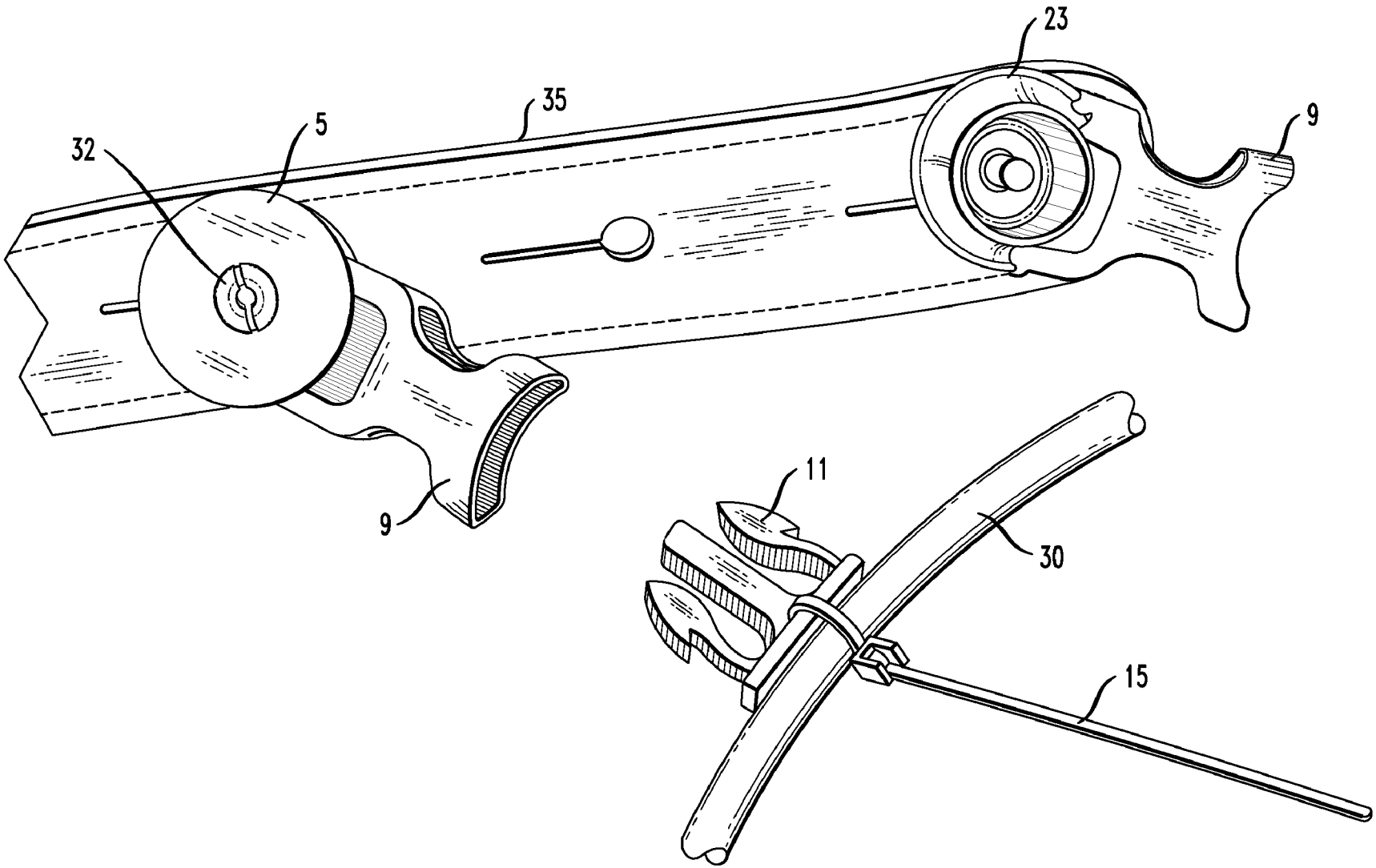
FIG. 6 illustrates another view of the aspect of FIG. 4 in conjunction with the cord securing apparatus of FIG. 1.

FIGS. 5 and 6 show the floating button 130 engaged to the first attachment portion 9 of the cord securing apparatus of an exemplary embodiment of the invention (only protrusion 32 of floating button 130 is visible in FIG. 6). Furthermore, retaining ring 28 of the strap locking device, which was omitted from FIG. 2, is shown in FIG. 5. In FIG. 5, the button 130 is shown from a side view as engaged with the first attachment portion 9 and in relation to the multi-hole guitar strap 35. In FIG. 6, the floating button 130 is behind the multi-hole guitar strap 35 and further receiving and engaged to the first attachment portion 9. As illustrated in FIG. 6, an additional first attachment portion 9 is secured to the locking system lock (having recessed washer 23) which is provided in another strap hole 37. In this embodiment, the guitar player can choose to secure the cord 30 to the floating button assembly via protrusion 32 or to the locking system assembly (having recessed washer 23), each via the exemplary inventive apparatus. FIG. 5 also shows a United States Quarter Dollar coin 132 to give an exemplary sense of the size of components 11, 9, 5, 130, and so on, it being understood that other sizes and proportions can be employed for the various components.

Figure 7:
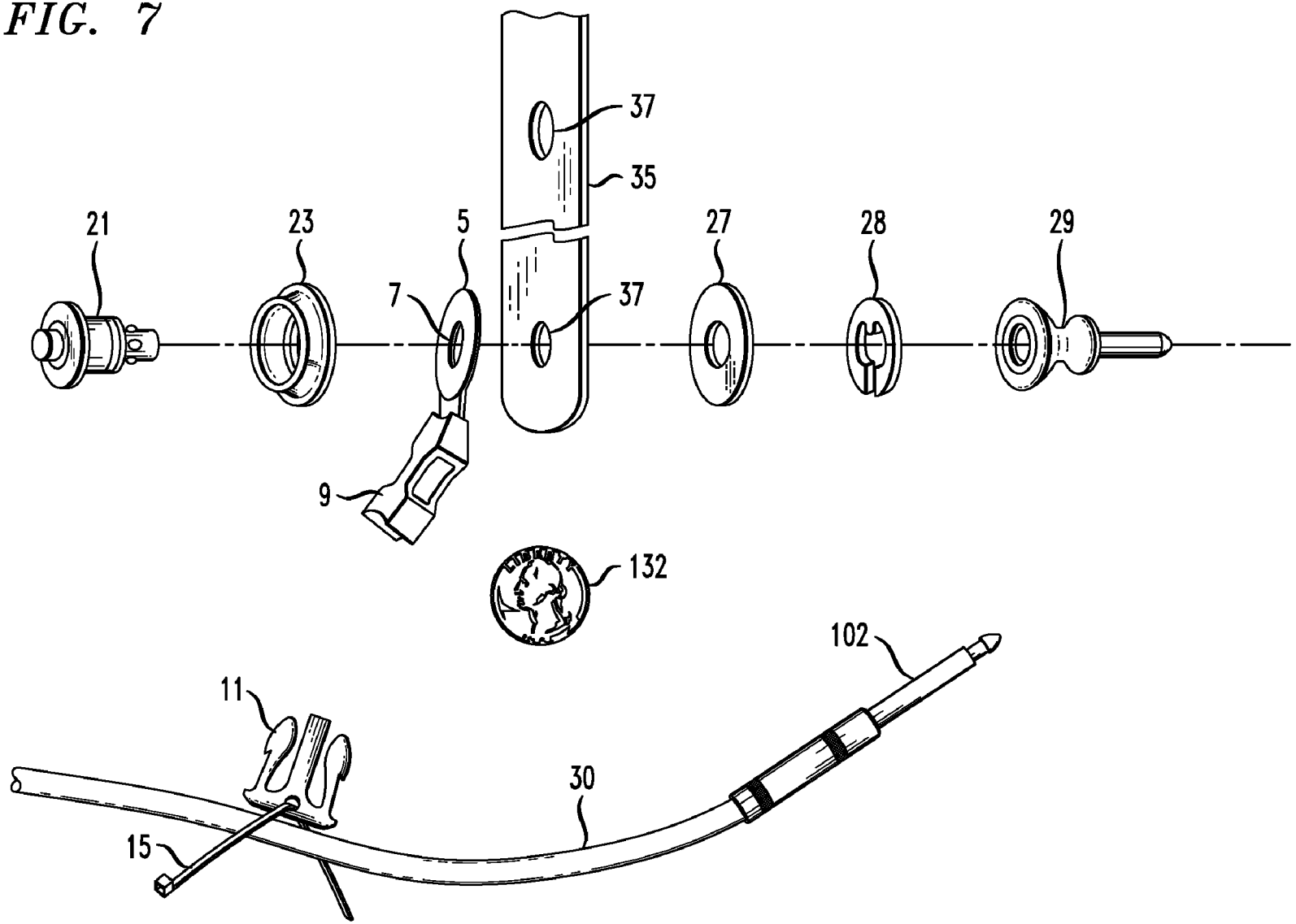
FIG. 7 is similar to FIG. 5 and shows an exemplary inventive apparatus adjacent one of several possible guitar strap holes.

FIG. 7 is similar to FIG. 5 but omits the felt portion 134 and floating button 130, showing protrusion receiving portion 5 with hole 7 aligned with an outermost hole 37 of multi-hole strap 37, it being understood that any of the holes could be engaged by the inventive apparatus.

Figure 8:
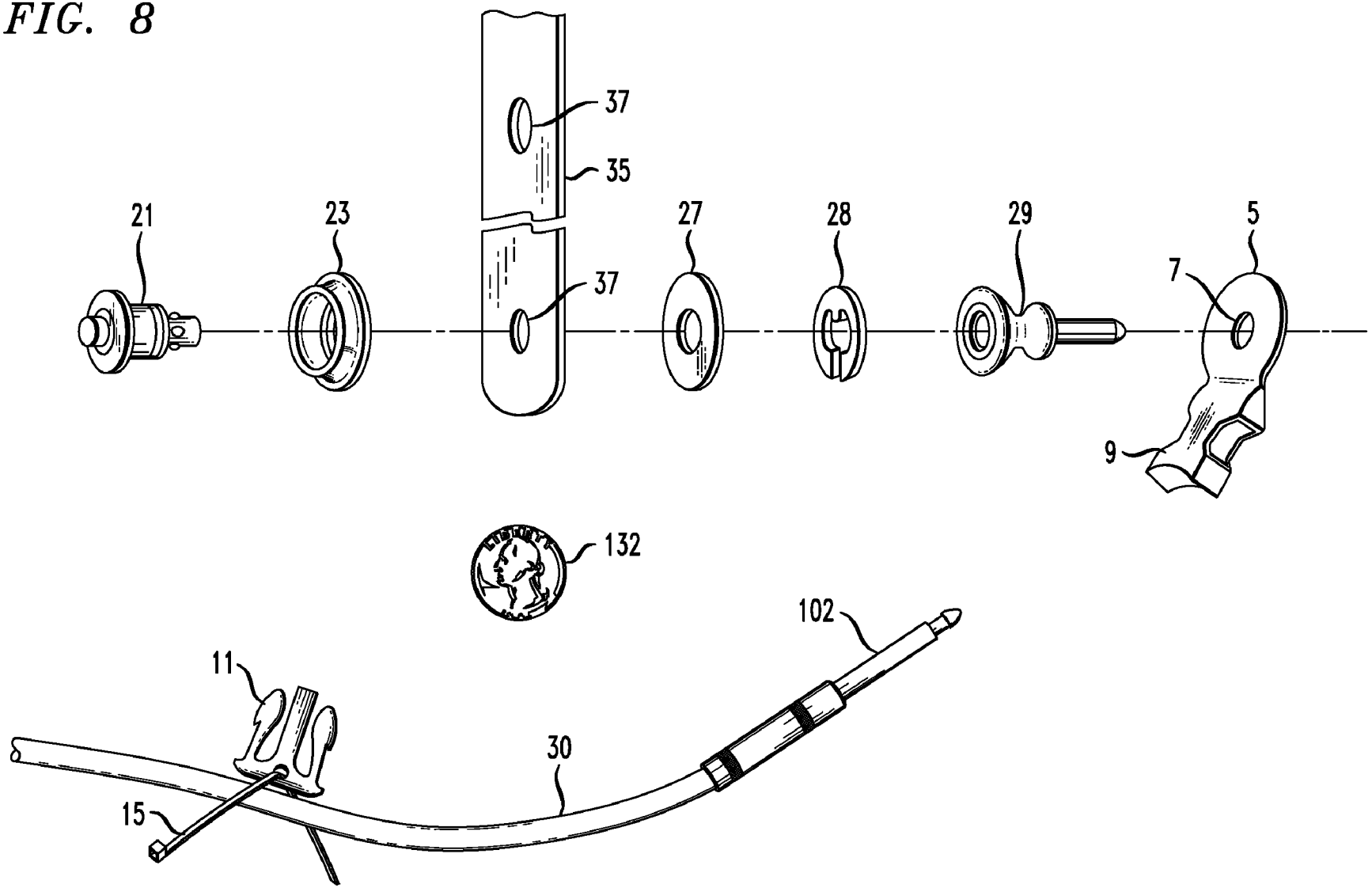
FIG. 8 is similar to FIG. 7 but shows an exemplary inventive apparatus adjacent a guitar strap button.

FIG. 8 is similar to FIG. 5 but omits the felt portion 134 and floating button 130, showing protrusion receiving portion 5 with hole 7 aligned with button 29 for purposes of being secured thereto and to a guitar (not shown) or other musical instrument.

Figure 9:
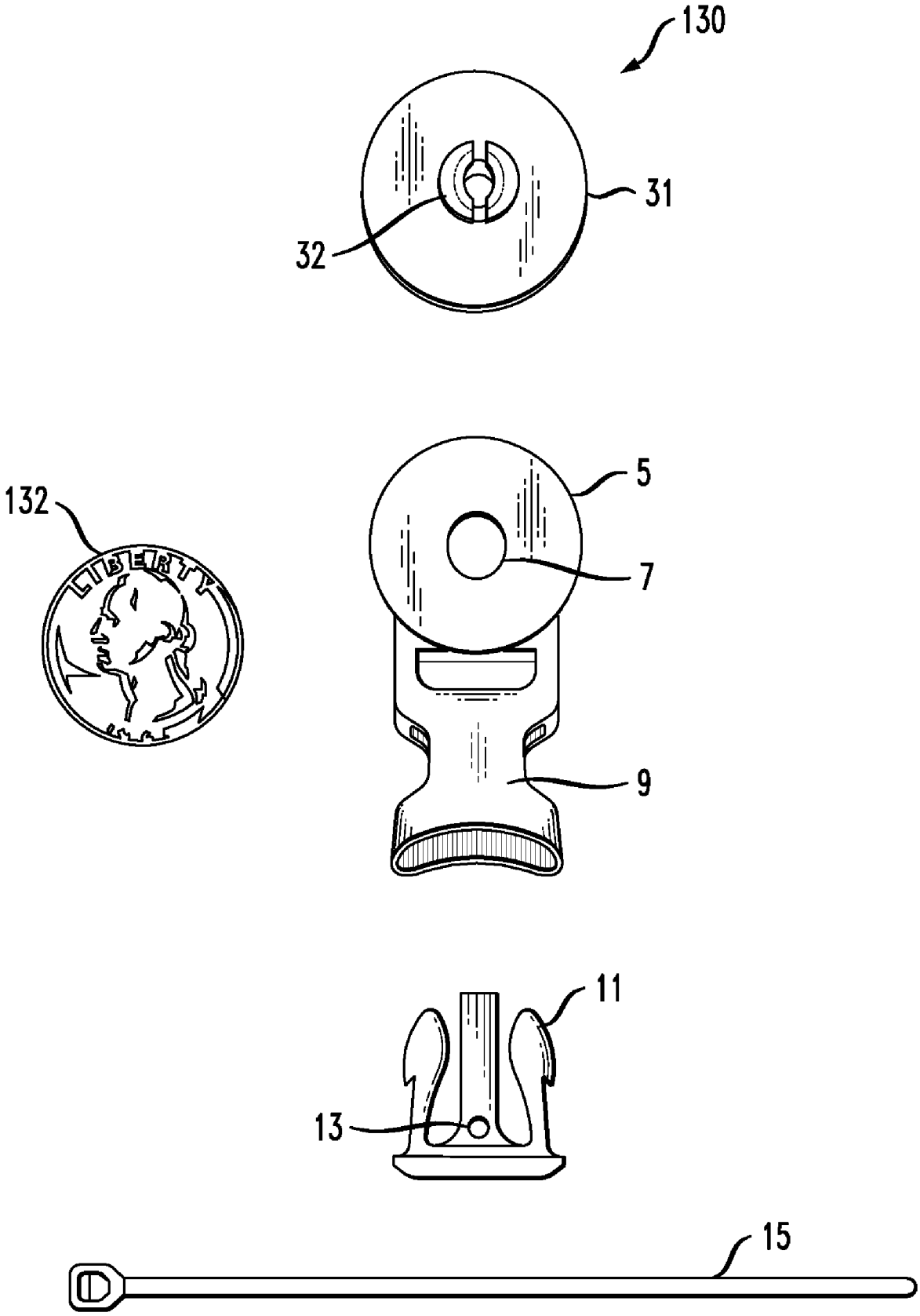
FIG. 9 is a detailed view of an exemplary inventive apparatus including a floating button that can be secured to a guitar strap.

FIG. 9 shows the elements depicted in FIG. 1 with a United States Quarter Dollar coin 132 to give an exemplary sense of the size thereof (in this exemplary embodiment), and also shows floating button 130 with base 31 and protrusion 32. Again, in other embodiments, different sizes or proportions may be employed.

Figure 10:
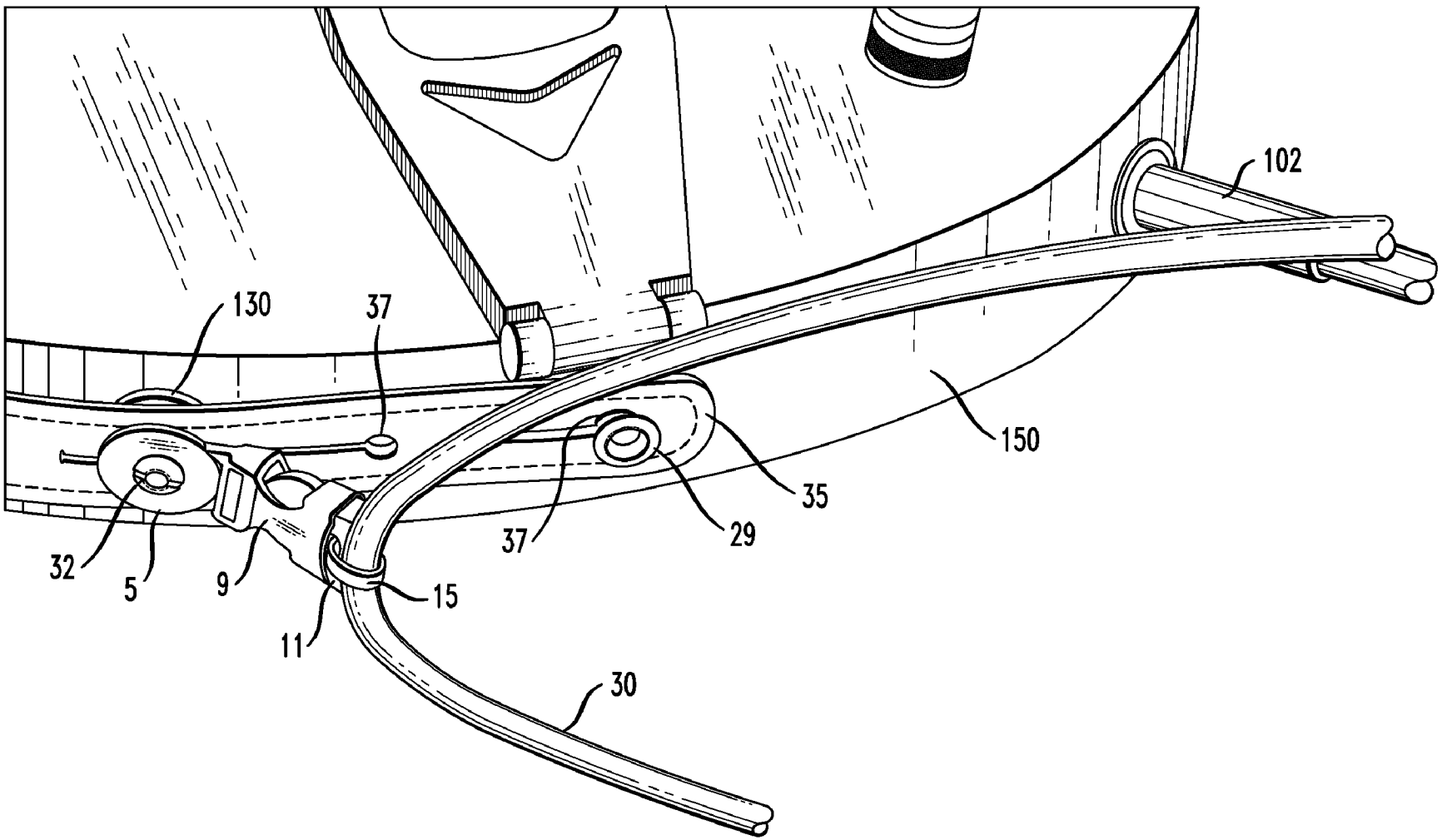
FIG. 10 shows an exemplary inventive apparatus secured to a strap hole of an electric guitar with another hole of the strap engaged with a guitar strap button.

FIG. 10 shows a multi-hole strap 35 secured to a conventional button 29 of electric guitar 150. An exemplary inventive apparatus including first attachment portion 9 with protrusion receiving portion 5 is secured in another hole 37 of strap 35 via protruding portion 32 of floating button 130. Protruding portion 32 may, for example, snap securely into hole 7 of portion 5. Cord 30 is secured to second attachment portion 11 via tie 15, and tensile loads on cord 30 are passed through the inventive apparatus to strap 35 and then to button 29, so that the chance of plug 102 unplugging from the guitar 150 is substantially reduced or eliminated.

Figure 11:
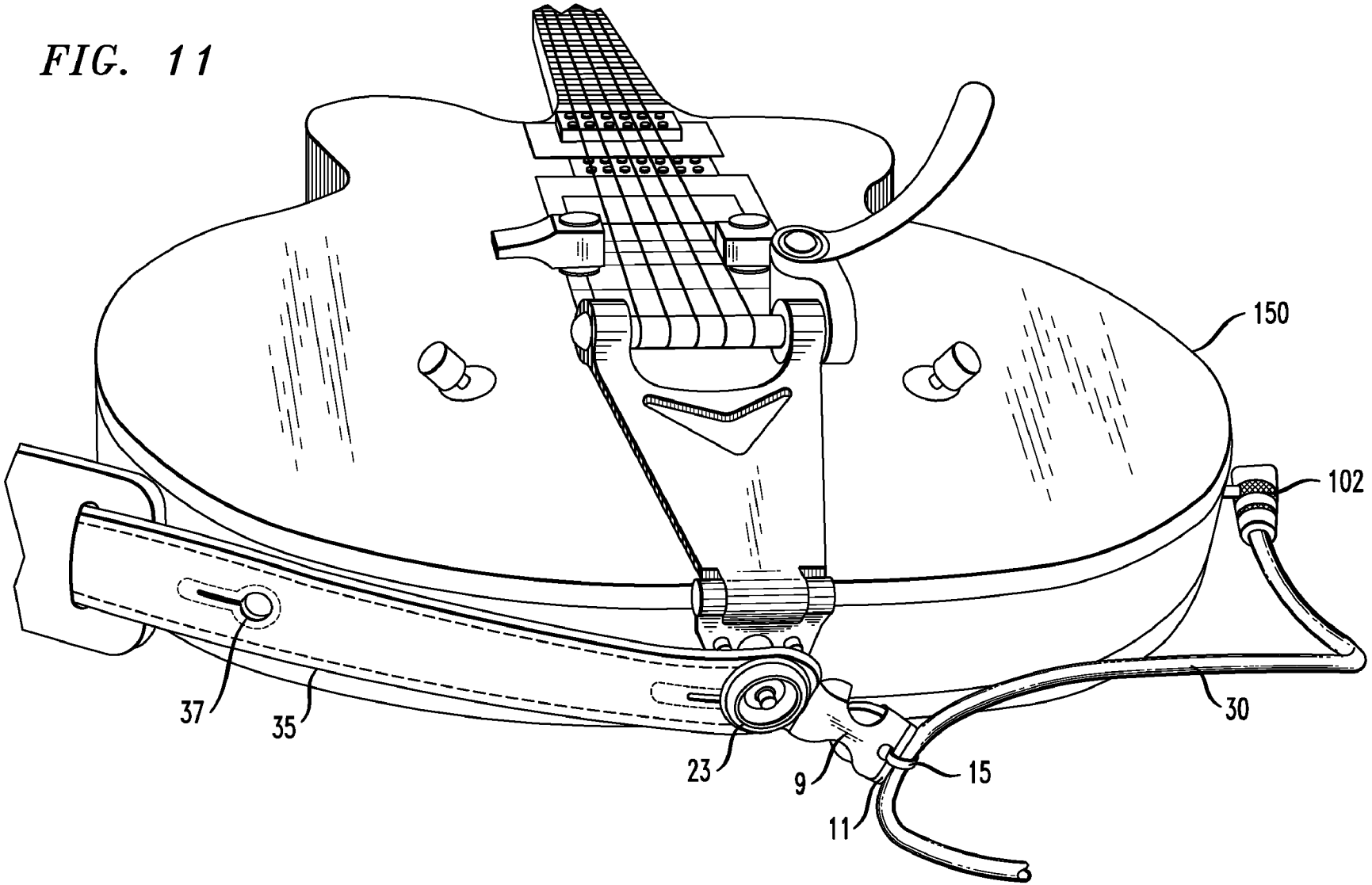
FIG. 11 shows an exemplary inventive apparatus secured to a strap hole of an electric guitar with the same hole of the strap engaged with a guitar strap button such as may be found in strap locking system.

FIG. 11 shows a multi-hole strap 35 secured to an electric guitar 150 via a strap locking system of the kind described above. Protrusion receiving portion 5 (not labeled in FIG. 11) of the exemplary inventive apparatus is located under recessed washer 23 of the strap locking system. Cord 30 is secured to second attachment portion 11 via tie 15, and tensile loads on cord 30 are passed through the inventive apparatus to the button of the strap locking system, to which recessed washer 23 is secured, so that the chance of plug 102 unplugging from the guitar 150 is substantially reduced or eliminated.

Figure 12:
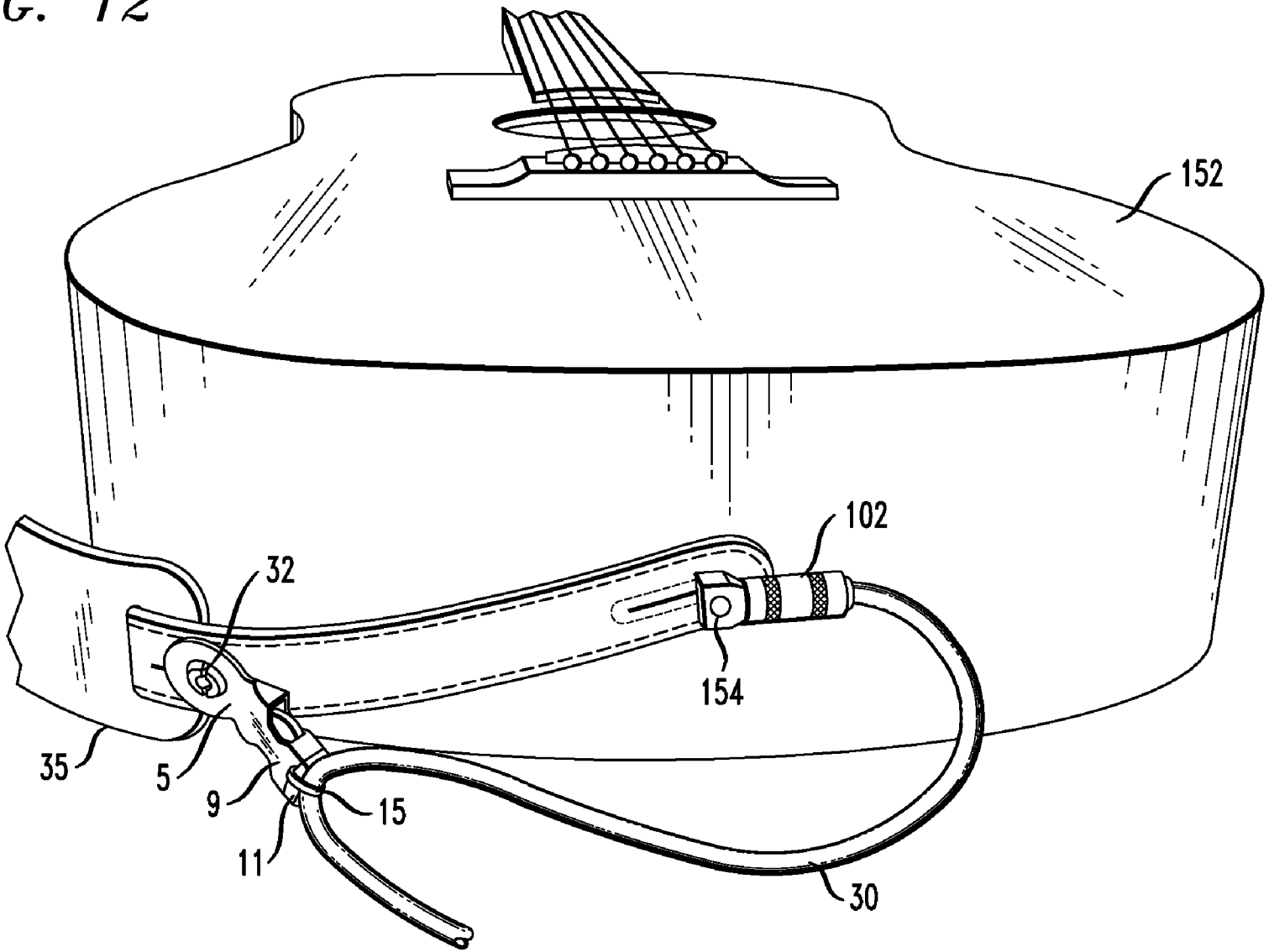
FIG. 12 shows an exemplary inventive apparatus secured to a strap hole of an acoustic-electric guitar with another hole of the strap engaged with a guitar strap button that is integral with a pick-up of the acoustic-electric guitar.

FIG. 12 shows a multi-hole strap 35 secured to a combined button/cord insertion jack 154 of acoustic-electric guitar 152. An exemplary inventive apparatus including first attachment portion 9 with protrusion receiving portion 5 is secured in another hole of strap 35 via protruding portion 32 of the floating button. Protruding portion 32 may, for example, snap securely into the hole of portion 5. Cord 30 is secured to second attachment portion 11 via tie 15, and tensile loads on cord 30 are passed through the inventive apparatus to strap 35 and then to combined button/cord insertion jack 154, so that the chance of plug 102 unplugging from the guitar 152 is substantially reduced or eliminated.

Many variations are within the inventive scope. For example, these include different embodiments of the assembled apparatus, an assembly (combination) including the apparatus and a strap and/or guitar (or other similar instrument), and a kit of parts (which may be appropriately packaged) including some or all of the parts described with assembly instructions describing how to employ same. Furthermore, other types of musical instruments besides guitars are within the inventive scope, for example, electric banjos. In addition, it should be noted that except for the felt portion 134, elements of the inventive apparatus are preferably made from injection-molded plastic. Also, it should be noted that users may add holes to single-hole straps 25 to facilitate use with some embodiments of the invention.

Although the present invention has been described with reference to specific exemplary embodiments, it will be evident that various modifications and changes may be made to these embodiments without departing from the broader spirit and scope of the invention. Therefore, the specification and drawings are to be regarded in an illustrative rather than a restrictive sense.

In another aspect, turning back to FIG. 2, an extra first attachment portion 9 and a protrusion-receiving portion 5 could be secured, for example, to a non-instrument structural member such as a column 500 of a microphone stand or music stand. A binding member 16 or other suitable member could be used for such securing function. Extra portion 9 could also be formed according to the alternative embodiment of FIG. 3. When changing instruments, the musician can unplug the cord of the instrument that is not going to be used, place element 11 for the cord into extra portion 9 secured to the column, and the cord would then be readily available when the next instrument is to be plugged in.

What is claimed is:

1. A cord securing apparatus comprising:

a musical instrument having an electrical pickup socket;

a strap secured to said musical instrument at least one mounting point;

an electrical pickup cord plugged into the electrical pickup socket;

a first securing section including a protrusion-engaging portion secured to at least one of the strap and the at least one mounting point;

a second securing section structurally connected to the first securing section and including a first coupling member; and a second coupling member secured to the electrical pickup cord, the second coupling member being mated to the first coupling member so as to take on tensile loads on the electrical pickup cord to reduce likelihood of the electrical pickup cord unplugging from the electrical pickup socket.

2. The apparatus according to claim 1, further comprising a cord connector engageable with the electrical pickup cord and the second coupling member, wherein the second coupling member is secured to the electrical pickup cord with the cord connector.

3. The apparatus of claim 1, further comprising a floating button member adapted to engage the protrusion-engaging portion, wherein the strap has at least one strap hole therein and wherein the floating button member includes a base having a front surface and a protrusion extending from the front surface, the protrusion passing through the strap hole and securably engaging with the protrusion-engaging portion.

4. The apparatus of claim 3, wherein the base includes a back surface having a protective layer thereon.

5. The apparatus of claim 1, wherein the protrusion-engaging portion comprises a hole formed in a surface proximate thereto.

6. The apparatus of claim 1, wherein the protrusion-engaging portion comprises a removable tie strap adapted for integration with the first section.

7. The apparatus of claim 1, wherein the musical instrument comprises a stringed musical instrument.

8. The apparatus of claim 7, wherein the stringed musical instrument comprises a guitar.

9. The apparatus of claim 1, wherein the first securing section is secured to the at least one mounting point.

10. The apparatus of claim 1, wherein the first securing section is secured to the strap.

11. A kit of parts for securing an electrical pickup cord of a musical instrument having an electrical pickup socket, said kit of parts comprising:

a first securing section including a protrusion-engaging portion securable to at least one of a musical instrument strap of the musical instrument and a musical instrument strap mounting point of the musical instrument;

a second securing section structurally connected to said first securing section and including a first coupling member;

a second coupling member securable to the electrical pickup cord, said second coupling member being configured to mate to said first coupling member so as to take on tensile loads on the electrical pickup cord to reduce likelihood of the electrical pickup cord unplugging from the electrical pickup socket; and instructions instructing a user of said kit to:

secure said first securing section to the at least one of the musical instrument strap of the musical instrument and the musical instrument strap mounting point of the musical instrument; and secure said second coupling member to the electrical pickup cord and mate said second coupling member to said first coupling member so as to take on tensile loads on the electrical pickup cord to reduce likelihood of the electrical pickup cord unplugging from the electrical pickup socket.

12. The kit of claim 11, wherein said instructions instruct said user to secure said first securing section to the at least one mounting point.

13. The kit of claim 11, wherein said instructions instruct said user to secure said first securing section to the strap.

14. The kit of claim 13, further comprising a floating button member adapted to engage the protrusion-engaging portion, wherein the strap has at least one strap hole therein and wherein said floating button member includes a base having a front surface and a protrusion extending from the front surface, said instructions further instructing said user to pass the protrusion through said strap hole and securably engage said protrusion with the protrusion-receiving portion.

* * * * *